US011046338B2

(12) United States Patent
Aquino De Oliveira et al.

(10) Patent No.: US 11,046,338 B2
(45) Date of Patent: Jun. 29, 2021

(54) ELECTRICAL TRAIN COUPLING

(71) Applicant: Voith Patent GmbH, Heidenheim (DE)

(72) Inventors: Renato Guimaraes Aquino De Oliveira, Sao Paulo (BR); Daiana Pinto Da Silva, Sao Bernardo do Campo (BR)

(73) Assignee: VOITH PATENT GMBH, Heidenheim (DE)

( * ) Notice: Subject to any disclaimer, the term of this patent is extended or adjusted under 35 U.S.C. 154(b) by 0 days.

(21) Appl. No.: 16/762,214

(22) PCT Filed: Aug. 22, 2018

(86) PCT No.: PCT/EP2018/072613
§ 371 (c)(1),
(2) Date: May 7, 2020

(87) PCT Pub. No.: WO2019/091617
PCT Pub. Date: May 16, 2019

(65) Prior Publication Data

US 2020/0353959 A1 Nov. 12, 2020

(30) Foreign Application Priority Data

Nov. 13, 2017 (DE) ..... 102017126546.5

(51) Int. Cl.
*B61G 5/10* (2006.01)
*H01R 13/447* (2006.01)
(Continued)

(52) U.S. Cl.
CPC ..... *B61G 5/10* (2013.01); *H01R 13/447* (2013.01); *H01R 13/5202* (2013.01);
(Continued)

(58) Field of Classification Search
CPC ..... H01R 13/447; H01R 13/5202; H01R 13/639; H01R 2201/26
(Continued)

(56) References Cited

U.S. PATENT DOCUMENTS 3,646,498 A * 2/1972 Reed ..... B61G 5/10 439/188
3,678,442 A * 7/1972 Cope ..... B61G 5/10 439/187
(Continued)

FOREIGN PATENT DOCUMENTS

CN 106877090 A 6/2017
DE 2413556 A1 9/1975
(Continued)

OTHER PUBLICATIONS

International Search Report of PCT/EP2018/072613, dated Nov. 9, 2018.

*Primary Examiner* — Alexander Gilman
(74) *Attorney, Agent, or Firm* — Davidson, Davidson & Kappel, LLC

(57) ABSTRACT

An electrical train coupling having two coupling halves, each including at least one electrical contact element, which is electrically contactable with an electrical contact element of the particular other coupling half, including one electrical connection per coupling half. At least one electrical contact element of at least one coupling half is supported by a decoupling element movable against the force of a force accumulator at least also along a coupling direction of the coupling halves, the decoupling element, in a coupled state of the two coupling halves, being moved against the force of the force accumulator into an electrically conductive contact of the electrical contact element with the electrical connection of the coupling half and, in a decoupled state of the two coupling halves, moved by the force of the force accumu-
(Continued)

lator with the electrical contact element, being lifted off of the electrical connection to disconnect the electrically conductive contact to the electrical connection.

13 Claims, 4 Drawing Sheets

(51) Int. Cl.
*H01R 13/52* (2006.01)
*H01R 13/627* (2006.01)
*H01R 13/639* (2006.01)

(52) U.S. Cl.
CPC ..... *H01R 13/6276* (2013.01); *H01R 13/639* (2013.01); *H01R 2201/26* (2013.01)

(58) Field of Classification Search
USPC ..... 439/142
See application file for complete search history.

(56) References Cited

U.S. PATENT DOCUMENTS 3,771,110 A * 11/1973 Reed ..... B61G 5/10 439/737
4,316,304 A 2/1982 Parise et al.
5,658,159 A * 8/1997 Gardner ..... B61G 5/10 439/294
6,179,479 B1 * 1/2001 Crivelli ..... B61G 5/10 385/73
6,893,284 B1 5/2005 Fawcett et al.
7,345,639 B2 * 3/2008 Prill ..... H01Q 1/3233 343/711
7,575,462 B2 * 8/2009 Macey ..... B60D 1/64 439/352
9,124,020 B2 * 9/2015 Kameda ..... H01R 13/46
9,555,820 B2 * 1/2017 Ende ..... H01R 13/44
9,666,988 B2 * 5/2017 Gates ..... H01R 13/6397
10,199,766 B2 * 2/2019 Smajda ..... H01R 13/623
10,615,534 B2 * 4/2020 Herczeg ..... B60L 53/16
10,766,379 B2 * 9/2020 Hwang ..... H01R 13/5213
2014/0242855 A1 * 8/2014 Kan ..... H01R 13/5213 439/892

FOREIGN PATENT DOCUMENTS

EP 1052157 A2 11/2000
JP H04334908 A 11/1992
WO WO0046884 A1 8/2000

* cited by examiner

ELECTRICAL TRAIN COUPLING

The present invention relates to an electrical train coupling having two coupling halves each including at least one electrical contact element, which may be electrically contacted with an electrical contact element of the particular other coupling half, and a coupling half for such an electrical train coupling.

BACKGROUND

In rail vehicles having automatic central buffer couplings, as the present invention relates to in particular, in addition to the mechanical coupling, an electrical train coupling is provided. An electric power supply and/or electric signals is/are transmitted between the vehicles coupled to one another, such as a locomotive and railcars, using such an electrical train coupling. These electrical train couplings are generally coupled and decoupled manually, for example, with the aid of screw closures or other locking units. The manual coupling is accordingly linked to a time expenditure.

DE 24 13 556 A1 provides an automatically connecting electrical train coupling, in which the coupling and decoupling is carried out by actuating the mechanical central buffer coupling. The electrical train coupling includes contact pins and contact sockets enclosed by an insulation bushing, both coupling parts being able to be designed identically. The contact pins and contact sockets are enclosed by a sleeve movable in the axial direction, to which a force accumulator is applied in such a way that it moves toward the free end of the coupling half, i.e., the axial end of the coupling half which faces toward the particular other coupling half, to thus enclose the contact pins and contact sockets in the interior of the coupling half in such a way that the sleeve is pushed over the contacts. The coupling halves may be closed on the end faces with the aid of a pivotable cover. Sealing lips on the frontal end of the coupling halves seal off the two coupling halves in relation to one another in the coupled state.

SUMMARY OF THE INVENTION

The described automatic electrical train coupling has the disadvantage that due to the enclosure of the electrical contact elements by the sleeve to which the force accumulator is applied, an insulation in relation to the coupling housing is achieved and also, in the coupled state of the two coupling halves, an insulation of the electrical train coupling against an engagement from the outside is ensured, but in the decoupled state, at least with raised cover, the risk exists that an operator will be subjected to an electric current by reaching into the sleeve. This is also true of the intentional or inadvertent insertion of electrically conductive components or a tool into the sleeve.

It is an object of the present invention to provide an electrical train coupling which avoids the mentioned hazard due to an electrical discharge. The train coupling is advantageously at least to be able to be disengaged automatically, without the necessity of a manual intervention.

The electrical train coupling according to the present invention includes two coupling halves, each of which includes at least one electrical contact element. In general, a plurality of electrical contact elements is provided per coupling half. The electrical contact element or elements of the one coupling half are designed to be brought into electrically conductive contact with the electrical contact element or elements of the other coupling half upon coupling of the two coupling halves. The electrical contact element or elements of the one coupling half thus generally press directly against the electrical contact element or elements of the other coupling half in the coupled state of the two coupling halves, for example, with the aid of a frontal contact surface in each case or also by way of a plug-socket connection or pin-sleeve connection.

One electrical connection is provided per coupling half, via which the coupling half is supplied with electric current and/or electric signals and/or via which the electric current and/or the electric signals are conducted further out of the coupling half. In general, the electrical connection will include a plurality of power supply and/or signal lines, in particular, but not necessarily, one per electrical contact element. The lines may also be referred to as poles.

According to the present invention, the at least one electrical contact element of at least one coupling half is supported by a decoupling element movable against the force of a force accumulator at least also along a coupling direction of the coupling halves. Preferably, both coupling halves include a corresponding decoupling element.

The decoupling element is, in a coupled state of the two coupling halves, moved against the force of the associated force accumulator of the coupling half into an electrically conductive contact of the supported electrical contact element with the electrical connection of the coupling half. In a decoupled state of the two coupling halves, the decoupling element is lifted off of the electrical contact element of the electrical connection by the force of the force accumulator, so that the electrically conductive contact of the contact element to the electrical connection or with the electrical connection is disconnected.

Due to the design according to the present invention of at least one of the two coupling halves, preferably both coupling halves, having the movable decoupling element, the electrical contact elements, which are reachable from outside the coupling halves, in particular via a frontal opening in a coupling housing, are decoupled from the electrical connection of the coupling half, so that voltage or electric current is no longer applied to the electrical contact element or elements when the coupling half is disengaged from the coupled connection. An electric shock or an inadvertent electrical discharge or an electrical short circuit is thus avoided, even if at least one contact element is inadvertently touched.

In principle, an arbitrary movement of the decoupling element to fulfill the function according to the present invention is conceivable, as long as this movement is triggered and/or controlled by the coupling procedure or decoupling procedure of the two coupling halves. Therefore, at least a part of the movement of the decoupling element at least initially takes place in the coupling direction of the coupling halves during the coupling, this part being able to be minimal. This may be achieved, for example, by a pivot movement, a twist movement, or a linear movement of the decoupling element, various movements also being able to be combined with one another, for example, to form a pivot-displacement movement or twist-displacement movement.

However, the decoupling element preferably includes a carriage axially movable in the coupling direction or formed thereby, which supports the at least one electrical contact element of the coupling half. In particular in this specific embodiment, the electrical contact element includes a first contact surface facing toward the associated electrical contact element of the other coupling half and a second contact surface facing toward the electrical connection of its (own) coupling half, each for electrical contacting by a mutual contact.

According to one particularly advantageous specific embodiment of the present invention, one coupling half, preferably both coupling halves, include a housing movably accommodating the decoupling element, a seal being provided in the area of a first axial end of the housing, against which the decoupling element is pressed by the force accumulator in the decoupled state of the two coupling halves. A secure seal may thus be achieved at the axial free end of the housing, in particular having an IP degree of protection, the corresponding free axial end of the housing, i.e., the axial end of the housing which faces toward the particular other coupling half in the coupled state of the two coupling halves, being referred to as the first axial end. The opposing axial end of the coupling half may then be referred to as the second axial end. The electrical connection is in particular provided therein, so that upon a movement of the decoupling element in the direction from the first axial end toward the second axial end, the electrically conductive connection between the at least one electrical contact element and the electrical connection is established, and upon a movement of the decoupling element in the direction from the second axial end toward the first axial end, this electrical connection is disconnected.

The decoupling element may be manufactured at least partially from an insulation material or may include such a material to insulate the at least one electrical contact element in relation to the housing.

Preferably, a safety interlock is provided in the at least one coupling half or a safety interlock is provided in each of the two coupling halves, which, in the decoupled state of the two coupling halves, blocks the particular decoupling element against a movement of the electrical contact element in the direction of the electrical connection, the blockade being able to be canceled by a manual or automatic actuation of the safety interlock. In particular, a formfitting blockade is provided for the blocking.

According to one specific embodiment of the present invention, the housing of the one coupling half or the housings of the two coupling halves may each be closable with the aid of a cover at the first axial end. The cover is, for example, pivotably fastened on the housing. The cover is preferably movable between a closed position and an open position (opening position) and actuates the safety interlock to cancel the blockade in the open position. It is not necessary for the cover to always remain in this position, which actuates the safety interlock, in the open position, but rather it may be sufficient for the cover to initially be moved into this actuating position during the coupling procedure and subsequently be moved back somewhat in the direction of the closed position manually or by application of a pre-tensioning force, but remaining in an open position which does not obstruct the coupling of the two coupling halves.

The two coupling halves are preferably fixed on one another in the coupled state with the aid of a detent connection, the detent connection being retained with the aid of at least one spring element, so that above a predetermined traction force moving the coupling halves away from one another, the detent connection is disengaged against the spring force of the spring element.

In one robust and particularly reliable specific embodiment of the present invention, it is provided that both coupling halves each include a housing, which includes at least one axial detent projection having a radial detent opening and at least one detent element movable in the radial direction against the spring force, the detent element of the one coupling half being positioned to engage in the detent opening of the other coupling half, actuated by the spring force. The detent element is, for example, a spring-pre-tensioned, in particular a compression-spring-pre-tensioned ball, which is advantageously movable in the radial direction of the coupling half.

The detent projection may be formed, for example, by an axial projection extending along the circumference of the coupling half on the first axial end of the coupling half. The projection advantageously extends only over a part of the circumference of the coupling half, for example, over half or less. An opening extending in the axial direction may thus be provided in the remaining area of the circumference, into which the corresponding projection of the other coupling half plunges upon the coupling of the two coupling halves. The projections may include the at least one radial detent opening or a plurality of detent openings and the detent element, in particular a plurality of detent elements in each case, may be provided in the area of the axial openings. Of course, multiple axial projections per coupling half may also be provided.

In particular in the above-described design, it is possible that the two coupling halves are identically, at least with respect to the electrical contact element or elements, the decoupling element, and the housing. However, a complete identity of at least all functionally-relevant components may also be provided. An identity avoids male and female clutch halves having to be provided for pairing.

If a cover is provided at the axial end, i.e., at the first axial end of the housing, it is thus advantageously spring-pre-tensioned in the direction of its closed position. In particular, a seal is provided, using which the cover is sealed against the housing in its closed position to prevent the penetration of dirt, dust, moisture, or the like. An automatic, sealed closure of the housing may thus be achieved upon the decoupling of the two coupling halves.

Due to the advantageous provision of the detent connection between the two coupling halves, which disengages above a predetermined traction force, the automatic decoupling is possible particularly easily, since only a sufficiently high traction force has to be applied to the electrical train coupling to trigger the decoupling procedure. An extremely secure decoupled state of each coupling half is achieved by the movement of the decoupling element thus following, and preferably, the automatic closing of the cover.

A coupling half according to the present invention for an electrical train coupling includes at least one electrical contact element and one electrical connection, as described. In particular, the mentioned plurality of electrical contact elements is provided.

As described above, the at least one electrical contact element of the coupling half is supported by a decoupling element movable against the force of a force accumulator at least also along a coupling direction of the coupling half, this decoupling element being moved in a coupled state of the coupling half against the force of the force accumulator into an electrically conductive contact of the electrical contact element with the electrical connection of the coupling half and being lifted off of the electrical contact with the electrical connection to disconnect from the electrical connection moved by the force of the force accumulator having the electrical contact element in a decoupled state of the coupling half. The above-described details may preferably be designed individually or in combination with one another in the coupling half according to the present invention.

An extremely advantageous electrical train coupling including two coupling halves or one coupling half for such an electrical train coupling may be provided by the present invention, which precludes the risk of an electric shock for the operator. At the same time, a secure seal of each coupling half or both coupled coupling halves may preferably be achieved in the coupled and also in the decoupled state, for example, in the decoupled state by the sealed closed cover and/or by the seal between decoupling element and housing in the area of the first axial end of the particular coupling half, and in the coupled state by a frontal seal on the two ends facing toward one another of the housings of the two coupling halves, this seal also being able to effectuate the mentioned cover seal. The electrical train coupling may be manually coupled and decoupled. However, at least decoupling is also possible automatically. The electrical train coupling or the two coupling halves may be fastened suitably at a rail vehicle, for example, suspended with the aid of chains below a central buffer coupling.

BRIEF DESCRIPTION OF THE DRAWINGS

The present invention is described by way of example hereafter on the basis of an exemplary embodiment and the figures, in which.

DETAILED DESCRIPTION

Figure 1:
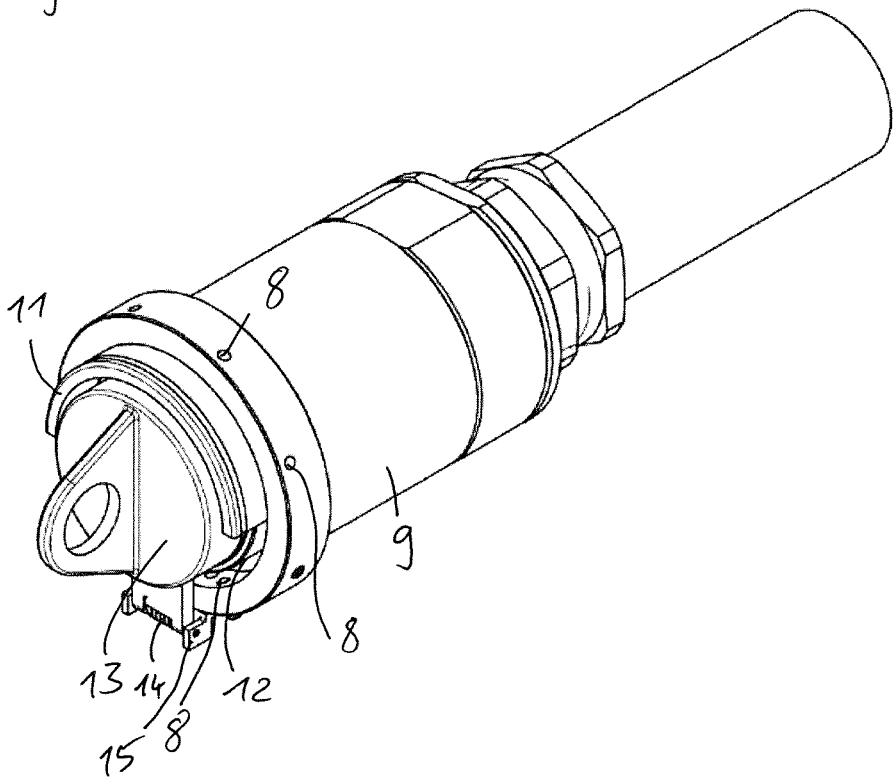
FIG. 1 shows a three-dimensional view of a coupling half according to the present invention in the decoupled state with closed cover.
Figure 2:
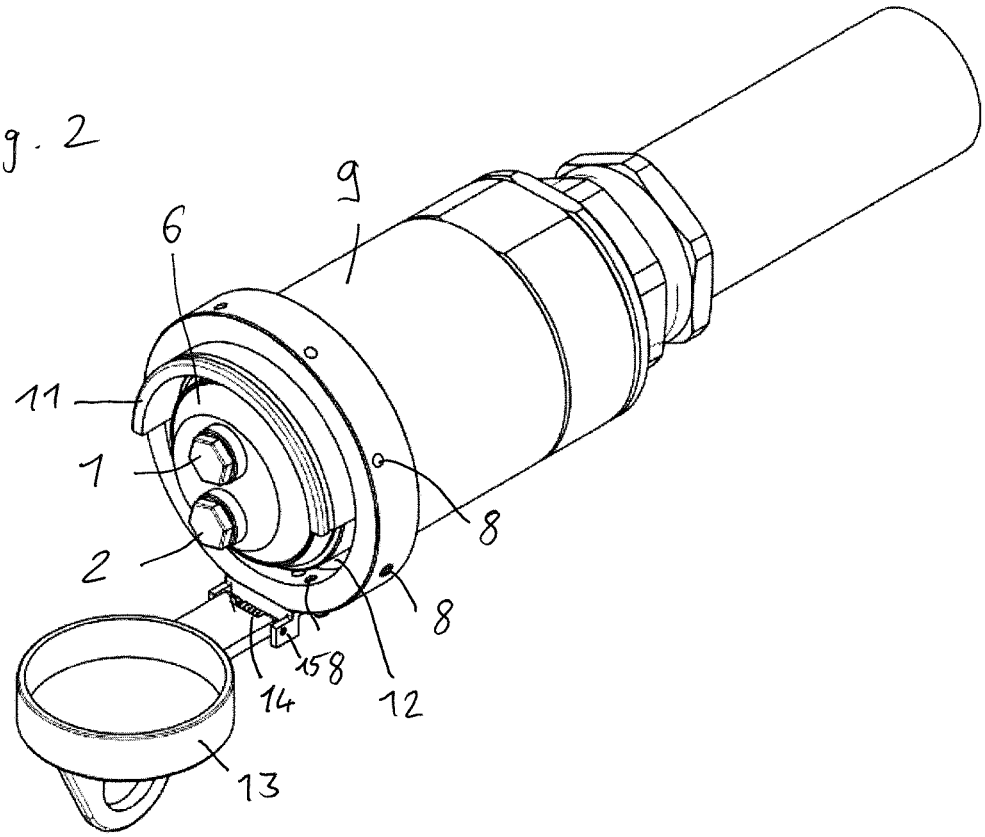
FIG. 2 shows the coupling half from FIG. 1 with open cover in a coupling state, but without a counter coupling half.

The coupling halves shown in FIGS. 1 through 8 are in particular designed identically to one another in such a way that they may form an electrical train coupling having two coupling halves in each case with one another. However, this is not obligatory, but avoids the provision of a female and a male coupling half.

In the illustrated exemplary embodiment, each coupling half includes two electrical contact elements 1, 2, a different number also being able to be provided in practice. Electrical contact elements 1, 2 include a first contact surface 3 oriented toward the free end of the coupling half. As is apparent from FIG. 6 in particular, first contact surfaces 3 facing toward one another of the coupling halves coupled to one another press against one another. Each coupling half furthermore includes an electrical connection 4 at the second axial end, i.e., the axial end facing away from the first axial end having contact surfaces 3 of electrical contact elements 1, 2. Electrical connection 4 includes two poles 4.1, 4.2 here, corresponding to the number of electrical contact elements 1, 2 per coupling half.

The two electrical contact elements 1, 2 each include a second contact surface 5, which faces toward electrical connection 4 or poles 4.1, 4.2 of electrical connection 4. In the decoupled state of the coupling halves, this second contact surface 5 is positioned remotely from poles 4.1, 4.2, see FIGS. 3 and 5. In the coupled state of the two coupling halves, second contact surface 5 presses against particular pole 4.1, 4.2 of electrical connection 4, see FIGS. 4 and 6, only the contact on a pole 4.1 being visible in FIG. 6 due to the selected sectional view.

Whether pressing of first contact surface 3 against particular pole 4.1, 4.2 is provided is dependent on the position of decoupling element 6, which supports electrical contact elements 1, 2, provided in the particular coupling half. Decoupling element 6 is positioned in the area of the first axial end in the decoupled state of the two coupling halves, so that the electrically conductive connection between electrical contact elements 1, 2 and electrical connection 4 is disconnected, because first contact surfaces 3 are lifted off of poles 4.1, 4.2. Upon coupling of the two coupling halves, decoupling element 6 is moved in the direction toward the second axial end of the particular coupling half against the force of force accumulator 7, in the form of a compression spring here, so that first contact surfaces 3 of electrical contact elements 1, 2 come into contact with poles 4.1, 4.2 and the electrical connection is established between electrical contact elements 1, 2 and electrical connection 4. The movement takes place due to mutual pressure application to both decoupling elements 6 or electrical contact elements 1, 2 thereof when the two coupling halves are plugged together.

Figure 7:
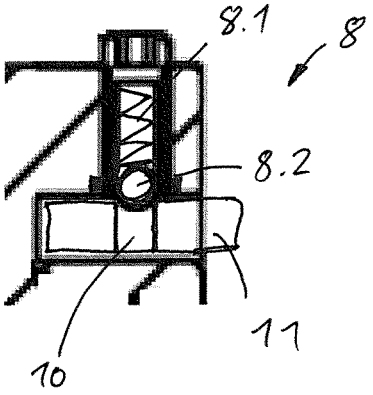
FIG. 7 shows a detail of a detent connection of the electrical train coupling according to FIGS. 5 and 6.

To retain the two coupling halves in the plugged-together, i.e., coupled state, a detent connection using a plurality of detent elements 8 movable against a spring force is provided, which are inserted movably in the radial direction into a housing 9 enclosing the particular coupling half. Such a detent element 8 is schematically shown in FIG. 7. It includes, for example, a ball 8.2 pre-tensioned by a compression spring 8.1, which engages in a radial detent opening 10 in an axial projection 11 of the particular other coupling half due to compression spring 8.1 in the coupled state of the two coupling halves, in order to establish the detent connection. One possible design of such an axial projection 11 is particularly apparent from FIGS. 1 and 2, according to which axial projection 11 extends in the axial direction and in the circumferential direction of coupling housing 9 and protrudes therefrom in the axial direction. An axial opening 12 is provided in the remaining circumferential section, in which axial projection 11 of the particular other coupling half may engage and into which detent elements 8 or balls 8.2 here protrude in a spring pre-tensioned manner. When the two coupling halves are pushed together, corresponding axial projection 11 plunges into axial opening 12 associated with it and balls 8.2 engage in corresponding detent openings 10 in axial projections 11. When the traction force is sufficiently large in the sense of moving the two coupling halves away from one another, balls 8.2 move radially outward against the force of compression springs 8.1 so that the form fit with particular axial projection 11 is disengaged.

In particular, a plurality of corresponding detent elements 8 is positioned distributed over the circumference of housing 9, at regular or irregular intervals in relation to one another.

In the decoupled state of the two coupling halves, housing 9 is frontally closed in the area of the first axial end by a cover 13. The closing may in particular be carried out "automatically" by a spring element 14, in the area of hinge 15 of cover 13 here. Cover 13 may press against a frontal seal 16 of the housing, which is apparent in particular in FIG. 4. Additionally or alternatively, a seal 17 may be provided in housing 9, against which decoupling element 6 presses in its position remote from electric connection 4, see FIG. 3. A particularly reliable seal of housing 9 in the decoupled state of a coupling half may thus be achieved.

In the coupled state of the two coupling halves, both housings 9 may be sealed against one another using seal or seals 16, since housings 9 press against one another frontally in this area.

Figure 3:
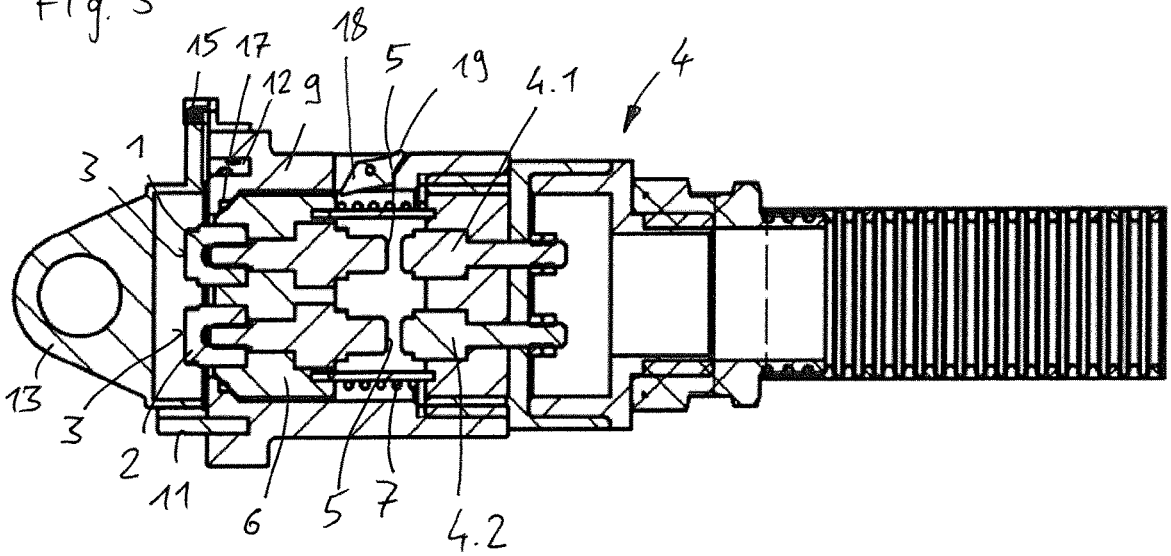
FIG. 3 shows an axial section through the coupling half from FIG. 1.
Figure 4:
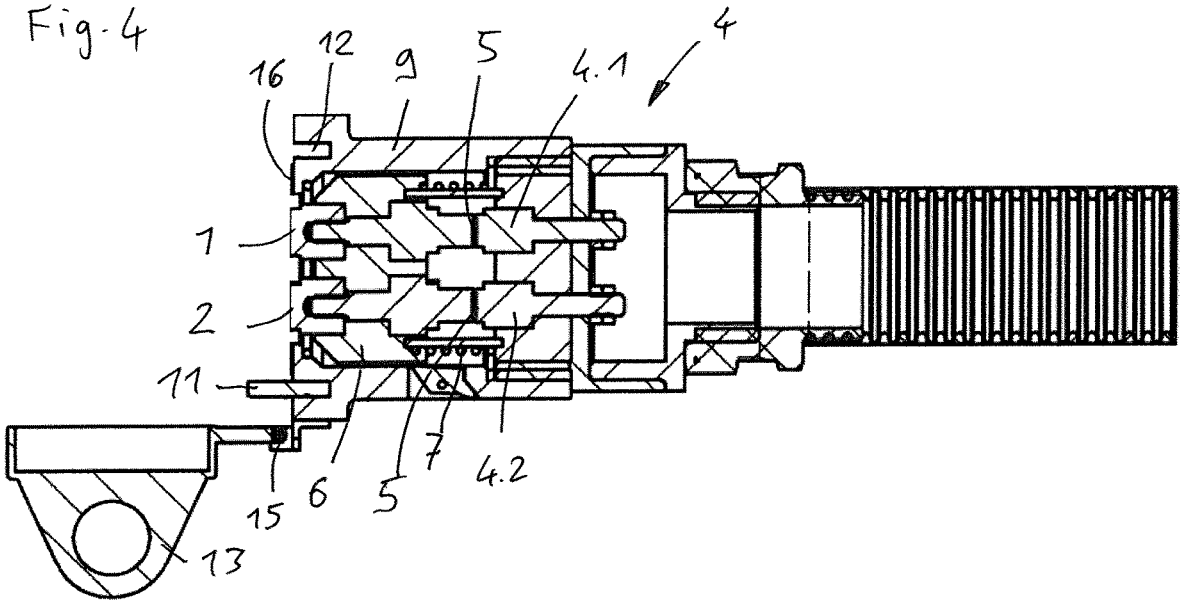
FIG. 4 shows an axial section through the coupling half from FIG. 2.
Figure 5:
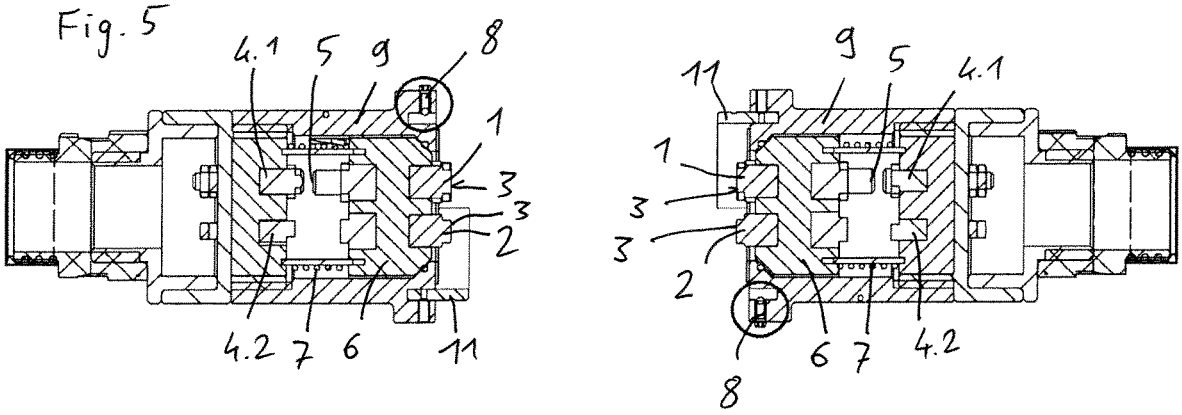
FIG. 5 shows an axial section through two coupling halves of an electrical train coupling according to the present invention in the decoupled state.
Figure 6:
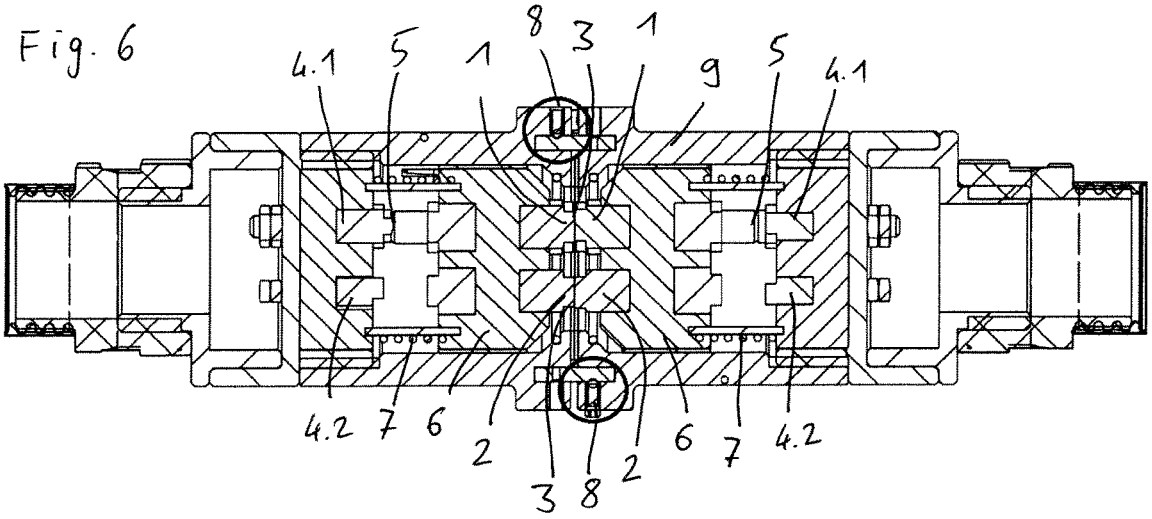
FIG. 6 shows the electrical train coupling from FIG. 5 in the coupled state of the two coupling halves.
Figure 8:
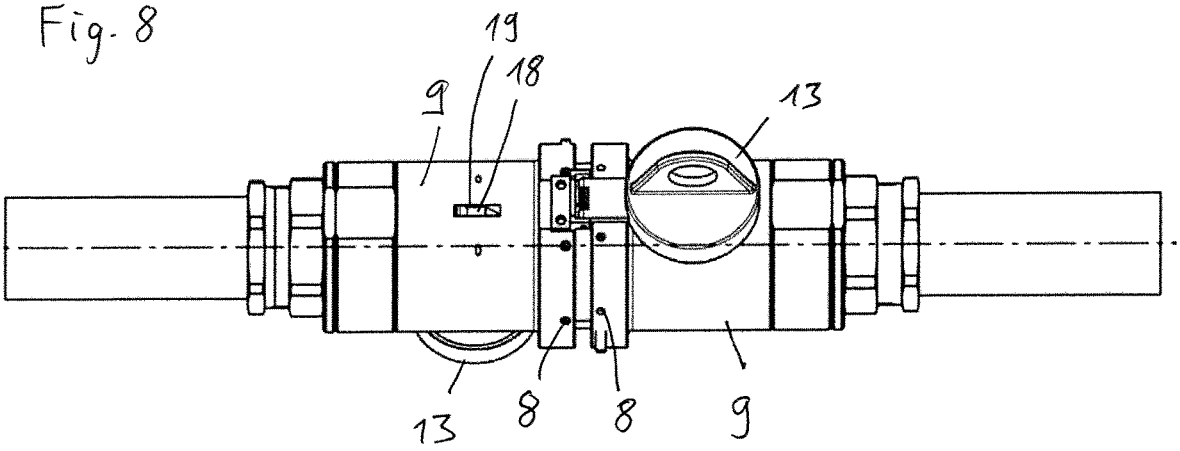
FIG. 8 shows a three-dimensional top view of an electrical train coupling in the coupled state.

To avoid inadvertent insertion of decoupling element 6 in the decoupled state of the coupling halves into housing 9 and thus the establishment of an electrically conductive contact between electrical contact elements 1, 2 and electrical connection 4, a safety interlock 18 is advantageously provided, which includes, for example, a latch 19 blocking decoupling element 6 in a formfitting manner against a movement in the direction toward the second axial end or in the direction toward electrical connection 4, which is apparent particularly from FIGS. 3 and 8 here. Latch 19 is mounted to be tiltable around a pivot point in housing 9 in such a way that in a locking position, it protrudes with one end radially outward from housing 9 and blocks decoupling element 6 against an axial displacement with another end at the same time. By actuating or pressing the end of latch 19 protruding out of housing 9, this blockade is disengaged, so that decoupling element 6 may be moved in the direction toward electrical connection 4. The actuation is advantageously carried out by cover 13, which accordingly includes a contact surface, which comes into contact with latch 19 for its actuation upon tilting of cover 13 in the direction toward the particular other coupling half, in order to press the end protruding radially outward from housing 9 radially inward.

LIST OF REFERENCE NUMERALS

1 electrical contact element
2 electrical contact element
3 first contact surface
4 electrical connection
4.1 pole
4.2 pole
5 second contact surface
6 decoupling element
7 force accumulator
8 detent element
8.1 compression spring
8.2 ball
9 housing
10 detent opening
11 axial projection
12 axial opening
13 cover
14 spring element
15 hinge
16 seal
17 seal
18 safety interlock
19 latch

The invention claimed is:

1. An electrical train coupling comprising:

two coupling halves, each including at least one electrical contact element electrically contactable with an electrical contact element of the respective other coupling half, including an electrical connection per coupling half;

the at least one electrical contact element of at least one of the two coupling halves being supported by a decoupler movable against a force of a force accumulator at least along a coupling direction of the coupling halves, the decoupler in a coupled state of the two coupling halves being moved against the force of the force accumulator into an electrically conductive contact of the electrical contact element with the electrical connection of the one coupling half; and the decoupler in a decoupled state of the two coupling halves being moved by the force of the force accumulator so the electrical contact element is lifted off of the electrical connection to disconnect the electrically conductive contact from the electrical connection; wherein the one coupling half includes a safety interlock, the safety interlock, in the decoupled state of the two coupling halves, blocking the decoupler against a movement of the electrical contact element in the direction of the electrical connection, the blocking being able to be canceled by a manual or automatic actuation of the safety interlock.

2. The electrical train coupling as recited in claim 1 wherein the decoupler includes a carriage axially movable in the coupling direction, the carriage supporting the electrical contact element of the one coupling half, the electrical contact element including a first contact surface facing toward a respective electrical contact element of the other coupling half and a second contact surface facing toward the electrical connection of the one coupling half, the first and second contact surfaces each for applied electrical contacting.

3. The electrical train coupling as recited in claim 1 wherein the one coupling half includes a housing movably accommodating the decoupler and a seal being provided in an area of a first axial end of the housing facing toward the respective other coupling half in the coupled state, the decoupler being pressed with the aid of the force accumulator in the decoupled state of the two coupling halves against the seal.

4. The electrical train coupling as recited in claim 1 wherein the safety blocks the decoupler in a formfitting manner.

5. The electrical train coupling as recited in claim 1 wherein the respective other coupling half includes a corresponding decoupler.

6. The electrical train coupling as recited in claim 1 wherein the two coupling halves each include a housing closable with the aid of a cover on a frontal first axial end facing toward the respective other coupling half.

7. The electrical train coupling as recited in claim 1 wherein the two coupling halves are fixed on one another with the aid of a detent connection in the coupled state, the detent connection being retained with the aid of at least one spring element and being disengaged above a predetermined traction force, moving the coupling halves away from one another, against a spring force of the spring element.

8. The electrical train coupling as recited in claim 7 wherein the two coupling halves each include a housing including at least one axial detent projection having a radial detent opening and at least one detent element movable in the radial direction against the spring force, the detent element of the one coupling half being positioned to engage in the detent opening of the other coupling half.

9. The electrical train coupling as recited in claim 1 wherein the two coupling halves are identical to one another at least with respect to the at least one electrical contact element and the decoupler.

10. The electrical train coupling as recited in claim 9 wherein the two coupling halves are identical to one another with respect to a housing of each of the two coupling halves.

11. A coupling half for an electrical train coupling as recited in claim 1, comprising:

an electrical contact element and an electrical connection, the at least one electrical contact element being supported by a decoupler movable against the force of a force accumulator at least along a coupling direction of the coupling halves, the decoupler in a coupled state of the electrical train coupling being moved against the force of the force accumulator into an electrically conductive contact of the electrical contact element with the electrical connection and the decoupler in a decoupled state of the electrical train coupling being moved by the force of the force accumulator so the electrical contact element is lifted off of the electrical connection to disconnect the electrically conductive contact to the electrical connection.

12. An electrical train coupling comprising:

two coupling halves, each including at least one electrical contact element electrically contactable with an electrical contact element of the respective other coupling half, including an electrical connection per coupling half;

the at least one electrical contact element of at least one of the two coupling halves being supported by a decoupler movable against a force of a force accumulator at least along a coupling direction of the coupling halves, the decoupler in a coupled state of the two coupling halves being moved against the force of the force accumulator into an electrically conductive contact of the electrical contact element with the electrical connection of the one coupling half; and the decoupler in a decoupled state of the two coupling halves being moved by the force of the force accumulator so the electrical contact element is lifted off of the electrical connection to disconnect the electrically conductive contact from the electrical connection; wherein the two coupling halves each include a housing closable with the aid of a cover on a frontal first axial end facing toward the respective other coupling half;

wherein the one coupling half has a safety interlock, the safety interlock in the decoupled state of the two coupling halves, blocking the decoupler against a movement of the electrical contact element in the direction of the electrical connection, the blocking being able to be canceled by a manual or automatic actuation of the safety interlock, wherein the cover is movable between a closed position and an open position, and in the open position actuates the safety interlock to cancel out the blockade.

13. The electrical train coupling as recited in claim 12 wherein the cover is pivotably attached on the housing.

* * * * *